US006725815B2

(12) United States Patent
Cannata

(10) Patent No.: US 6,725,815 B2
(45) Date of Patent: Apr. 27, 2004

(54) CAM-DRIVE ENGINE AND CYLINDER ASSEMBLY FOR USE THEREIN

(75) Inventor: Antonio Cannata, London (CA)

(73) Assignee: Attegro Inc., London (CA)

( * ) Notice: Subject to any disclaimer, the term of this patent is extended or adjusted under 35 U.S.C. 154(b) by 50 days.

(21) Appl. No.: 10/139,774

(22) Filed: May 6, 2002

(65) Prior Publication Data

US 2003/0205211 A1 Nov. 6, 2003

(51) Int. Cl.[7] ..... F02B 75/18

(52) U.S. Cl. ..... 123/56.1; 123/56.2; 60/299; 422/177

(58) Field of Search ..... 123/56.1, 90.11, 123/90.12, 56.2, 56.7; 60/299; 422/177, 179, 180

(56) References Cited

U.S. PATENT DOCUMENTS

| | | | | |
|---|---|---|---|---|
| 1,698,102 A | | 1/1929 | Michell | |
| 4,455,543 A | | 6/1984 | Pischinger et al. | 335/266 |
| 4,492,188 A | | 1/1985 | Palmer et al. | 123/58 |
| 4,834,033 A | | 5/1989 | Larsen | 123/58 |
| 4,869,212 A | | 9/1989 | Sverdlin | 123/56 |
| 4,974,555 A | | 12/1990 | Hoogenboom | 123/56 |
| 5,386,696 A | | 2/1995 | Prigent et al. | 60/300 |
| 5,437,251 A | * | 8/1995 | Anglim et al. | 123/56.3 |
| 5,813,372 A | | 9/1998 | Manthey | 123/43 |
| 6,158,406 A | | 12/2000 | Sunnarborg | 123/193.2 |
| 6,202,606 B1 | * | 3/2001 | Anttila | 123/56.1 |

* cited by examiner

*Primary Examiner*—Tony M. Argenbright
*Assistant Examiner*—Katrina B. Harris

(57) ABSTRACT

A cam-drive engine having one or more cylinder assemblies detachably affixed to an engine core that does not include a cylinder block per se. Each cylinder assembly can be attached to or detached from the engine core without the need for disassembly of the cylinder assembly unit. This allows cylinder assemblies to be easily removed or replaced for repair or cylinder assemblies to be easily added to an existing engine. The cylinder assemblies can include cylinder pressure and solenoid actuated intake and exhaust valves that facilitate attachment. The engine can further include a catalytic converter contained in a central hub proximate to the cylinder assemblies thereby facilitating rapid warm-up of the catalyst.

16 Claims, 10 Drawing Sheets

CAM-DRIVE ENGINE AND CYLINDER ASSEMBLY FOR USE THEREIN

FIELD OF INVENTION

The present invention relates to engines and in particular to a detachable cylinder assembly for use in a cam-drive engine and to solenoid operated valves and a catalytic converter for use in this type of engine.

BACKGROUND

Operable configurations of the reciprocating-piston internal combustion engine have been known for more than a century. In that time substantial developments have occurred that have resulted in ever higher levels of efficiency and reliability in engines being produced commercially. Despite this long legacy of improvement, these engines are still subject to wear and degraded operation with extended use. Once they have achieved long operating lives these engines commonly require internal repairs in the form of cylinder wall boring or honing and piston ring replacement.

Today most reciprocating-piston internal combustion engines are built around a cylinder block housing into which are machined either the cylinder bores directly or receivers for cylinder liners. In either case, the previously mentioned internal repairs require substantial disassembly of the engine and often removal of the entire engine from its operating environment. This holds true even when the repairs are to be carried out on only one or a small number of the cylinders in a multi-cylinder engine. The removal from service and the total labor required to carry out the repairs represents a substantial cost to the engine's user in particular where the engine is being used in a commercial application.

There exists a class of engines known as "cam-drive" or "swash plate" engines. These engines are often described as 'barrel' engines because many have a cylinder block that is substantially the shape of a large diameter, short cylinder. Although, it is well known that the "cam-drive" or "swash plate" engines have a number of benefits, the barrel configuration of the cylinder block common to this type of engine can cause difficulty in performing some maintenance or repair operations on these engines. In particular, in many implementations of the "cam-drive" or "swash plate" engine the cylinder block is a large mono-block or split-block which can require significant and complex disassembly in order to remove the pistons or to gain access to the inner cylinder walls as exemplified by the engine in U.S. Pat. No. 4,492,188 issued Jan. 8, 1985. For many of these engines it is difficult to imagine how they could receive cylinder maintenance (such as piston or ring replacement, cylinder boring or honing; etc.) without the complete removal of the engine assembly from its operating environment. Therefore, although "cam-drive" or "swash plate" engines are known to have numerous operating advantages over the more common crank-drive engines they are not superior in terms of ease of internal engine repair.

Growing concerns over environmental issues has led to the widespread adoption of legislation limiting exhaust emissions from internal combustion engines. One of the most significant technologies that has been adopted to help meet these emissions restrictions is the use of catalytic converters. Although catalytic converts have proven effective at reducing emissions in normal operation they do suffer from a significant shortcoming. That is, they are relatively ineffective until a minimum operating temperature has been achieved. This has led to the introduction of numerous ancillary solutions (e.g. supplemental fast warm-up converters, heating elements in the converters, etc.) which address the period of time between engine start-up and attainment of a sufficient operating temperature in the catalytic converter. These solutions add significant cost, complexity and weight to the emissions control systems.

SUMMARY OF INVENTION

The cam-drive engine and the cylinder assembly of the present invention are structured to permit installation and removal of the cylinder assembly to/from the engine without requiring disassembly of the cylinder assembly. The solenoid and cylinder pressure operated valves of the present invention facilitate the installation and removal of the cylinder assembly by eliminating the need for mechanical valve actuation. The catalytic converter of the present invention provides for fast warm-up of the catalyst by placing the converter proximate to the cylinder assembly.

In accordance with one aspect of the present invention, a cylinder assembly for detachable mounting on a cam-drive engine core having a drive shaft, a power plate affixed to said drive shaft, a power plate housing substantially supporting said drive shaft and said power plate, a cylinder connecting rod connected to said power plate, and a cylinder assembly mounting position connected to said power plate housing, said cylinder assembly comprising: a cylinder housing with attachment apparatus for detachably mounting at said mounting position, a cylinder head assembly affixed to an end of said cylinder housing, a piston positioned inside of said cylinder housing, a piston connecting pin connected to said piston, and an aperture in said cylinder housing through which said piston connecting pin is accessible for detachable connection to said cylinder connecting rod; wherein said cylinder assembly can be attached or detached to said engine core as an assembled unit.

In accordance with another aspect of the present invention, a cylinder assembly for detachable mounting on a cam-drive engine core having a drive shaft, a power plate affixed to said drive shaft, a power plate housing substantially supporting said drive shaft and said power plate, a cylinder connecting rod connected to said power plate, and a cylinder assembly mounting position connected to said power plate housing, said cylinder assembly comprising: a cylinder housing with attachment apparatus for detachably mounting at said mounting position, first and second cylinder head assemblies, one affixed to each end of said cylinder housing, first and second pistons positioned inside of said cylinder housing, a piston connecting rod connected at one end to said first piston and at another end to said second piston, a piston connecting pin connected to said piston connecting rod, and an aperture in said cylinder housing through which said piston connecting pin is accessible for detachable connection to said cylinder connecting rod, wherein said cylinder assembly can be attached or detached to said engine core as an assembled unit.

In accordance with a further aspect of the present invention, a cam-drive engine core for detachable mounting of a cylinder assembly having a cylinder housing with attachment apparatus for detachable mounting, a head assembly affixed to an end of said cylinder housing, a piston positioned inside of said cylinder housing, a piston connecting pin connected to said piston, and an aperture in said cylinder housing through which said piston connecting pin is accessible, said engine core comprising: a drive shaft, a power plate affixed to said drive shaft, a power plate housing substantially supporting said drive shaft and said power plate, a cylinder connecting rod, connected to said power plate, for detachable connection to said piston connecting pin, and a cylinder assembly mounting position, for detachably receiving said cylinder assembly attachment apparatus, connected to said power plate housing; wherein said cylinder assembly can be attached or detached to said engine core as an assembled unit.

In accordance with yet another aspect of the present invention, a cam-drive engine comprising: an engine core having a drive shaft, a power plate affixed to said drive shaft, a power plate housing substantially supporting said drive shaft and said power plate, a cylinder connecting rod connected to said power plate, and a cylinder assembly mounting position connected to power plate housing, and a cylinder assembly having a cylinder housing with attachment apparatus for detachable mounting at said mounting position, a head assembly affixed to an end of said cylinder housing, a piston positioned inside of said cylinder housing, a piston connecting pin connected to said piston, and an aperture in said cylinder housing through which said piston connecting pin is accessible for connection to said cylinder connecting rod; wherein said cylinder assembly can be attached or detached to said engine core as an assembled unit.

In accordance with still another aspect of the present invention, a cam-drive engine comprising: an engine core having a drive shaft, a power plate affixed to said drive shaft, a power plate housing substantially supporting said drive shaft and said power plate, a plurality of cylinder connecting rods connected to said power plate, and a plurality of cylinder assembly mounting positions connected to power plate housing, and a plurality of cylinder assemblies each having a cylinder housing with attachment apparatus for detachable mounting at one of said plurality of mounting positions, a head assembly affixed to an end of said cylinder housing, a piston positioned inside of said cylinder housing, a piston connecting pin connected to said piston, and an aperture in said cylinder housing through which said piston connecting pin is accessible for connection to one of said plurality of cylinder connecting rod; wherein each of said plurality of cylinder assemblies can be individually attached or detached to said engine core as an assembled unit.

In accordance with yet a further aspect of the present invention, a solenoid operated intake valve comprising: a gas flow port, a plunger, a resilient means biasing said plunger into a closed position sealing-off said gas flow port, means for locking said plunger in said closed position, and a solenoid for driving said plunger into an open position exposing said gas flow port.

In accordance with still a further aspect of the present invention, a pressure differential and solenoid operated exhaust valve comprising: a gas flow port, a plunger, a resilient means damping said plunger as it is driven in to an open position, exposing said gas flow port, by a pressure differential across said plunger, a solenoid for driving said plunger into a closed position sealing-off said gas flow port, and means for locking said plunger in said closed position.

In accordance with still another aspect of the present invention, a catalytic converter for proximate location to a cylinder assembly comprising: a substantially cylindrical inner body, a substantially cylindrical outer body whose radius is greater than that of said inner body, a cylinder assembly mounting position, to which said cylinder assembly can be affixed, disposed on the outer surface of said outer body, a plurality of supporting webs that extend from the inner body to the outer body, a catalytic carrier disposed within a cavity formed between said inner body, said outer body and said supporting webs, a catalyst disposed on said catalyst carrier, a first end cap sealing a first end of said cavity, an entry port in said first end cap to admit exhaust gases from said cylinder assembly to said cavity, via a exhaust runner; a second end cap sealing a second end of said cavity, an exit port connecting said cavity to the interior of said inner body, and an exhaust port in said first end cap through which exhaust gases in said inner body can flow; whereby the catalyst is effective at reducing the emissions of exhaust gases from said cylinder assembly circulated via said entry port, through said cavity to said exit port.

Other aspects and features of the present invention will become apparent to those ordinarily skilled in the art upon review of the following description of specific embodiments of the invention in conjunction with the accompanying figures.

BRIEF DESCRIPTION OF DRAWINGS

The present invention will be described in conjunction with the drawings in which.

DETAILED DESCRIPTION

Figure 1:
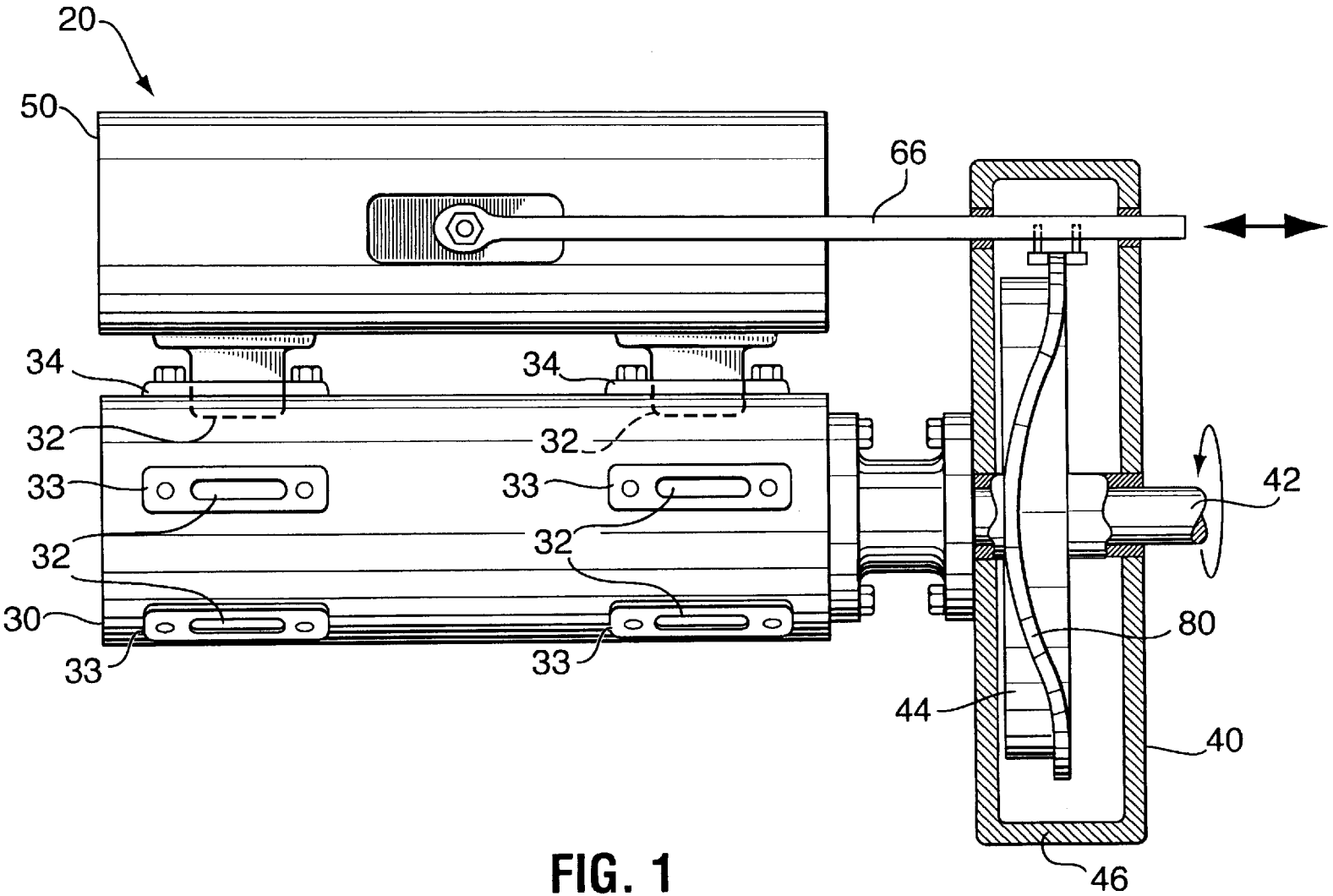
FIG. 1 represents a side plan of the engine of the present invention.
Figure 7A:
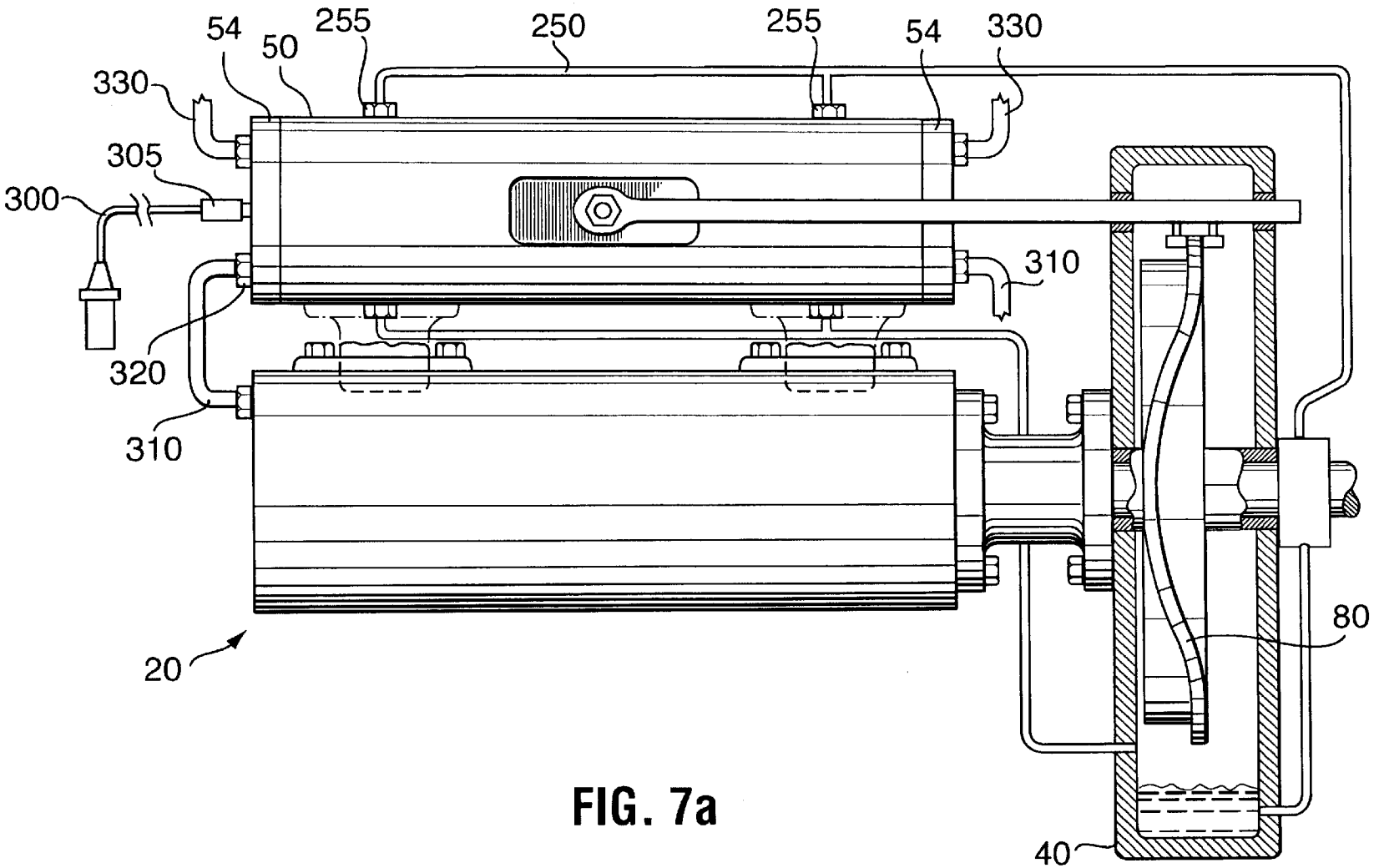
FIGS. 7*a–c* represent side plans of the engine of the present invention in stages of disassembly.
Figure 7B:
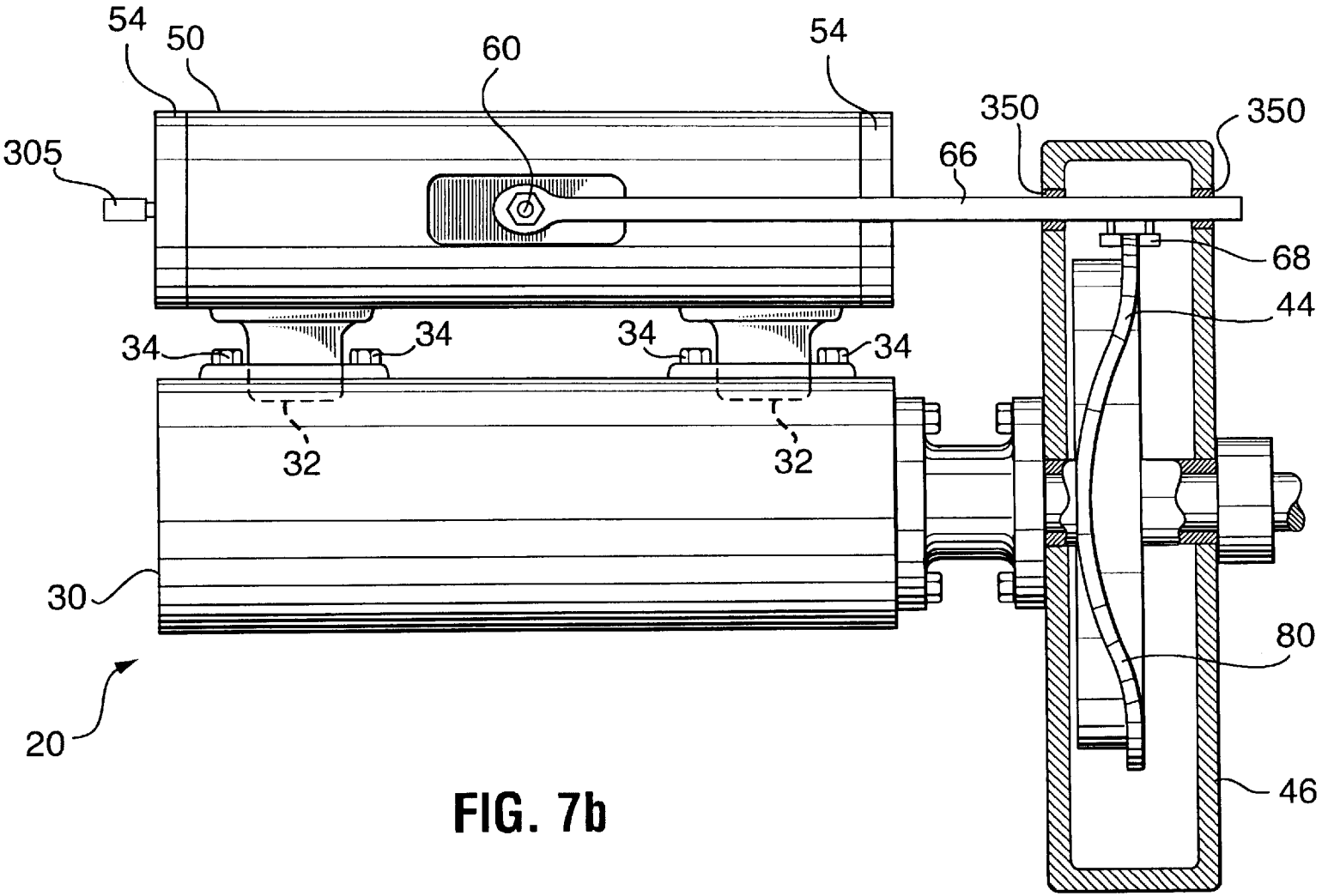
Figure 7C:
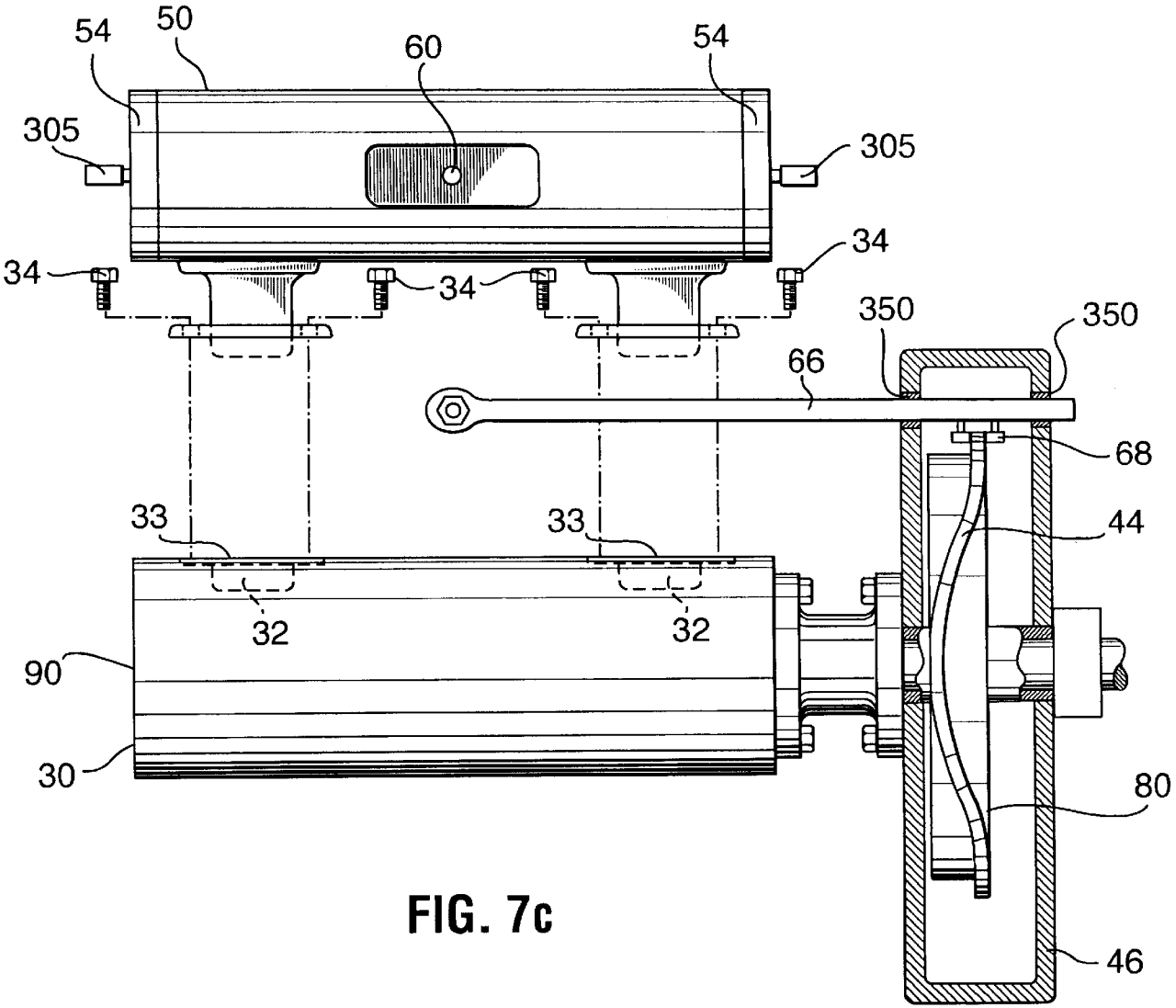

FIGS. 1, 7*c* and the associated description represent an exemplary embodiment of an engine 20, including a detachable cylinder assembly 50, of the present invention. The engine 20 comprises an engine core 90 and a cylinder assembly 50. The engine core 90 comprises a power plate assembly 40, a hub 30 connected to the power plate assembly 40 and a cylinder connecting rod 66. The cylinder assembly is connected to the hub 30 and to the power plate assembly 40 via the cylinder connecting rod 66. The power plate assembly 40 comprises a drive shaft 42, a power plate 44 affixed to the shaft and a housing 46 substantially supporting the other components. The power plate 44 may take on many forms that are well known for use in "cam-drive" or "swash plate" engines. In particular the power plate 44 can be a canted disc or a cam adapted to cooperatively transform reciprocating motion to rotational torque and therefore rotational motion of the drive shaft 42.

The hub 30 attaches to the power plate assembly 40 and provides support for the cylinder assembly 50 relative to the power plate assembly 40. The hub 30 can, for example, be substantially cylindrical having mounting positions 33 for attaching the cylinder assemblies disposed circumferentially on its outer surface. The hub 30 can be configured to provide mounting positions for one or more cylinder assemblies. Other configurations of the engine may not include a hub 30.

The cylinder assemblies can alternatively be affixed and supported in other ways including, but not limited to, direct connection to the power plate assembly 40 or through another mounting structure which is not a hub 30 per se.

It will be understood by those ordinarily skilled in the art that although the figures and descriptions of the various embodiments of the present invention focus primarily on the major structural components of the engine, the engine of the present invention would include appropriate ancillary systems (e.g. induction, exhaust, fuel delivery, ignition, lubrication, cooling and other similar systems) in order to create a running engine. These systems, except where otherwise noted, comprise well know apparatus and methods in common use.

Figure 2A:
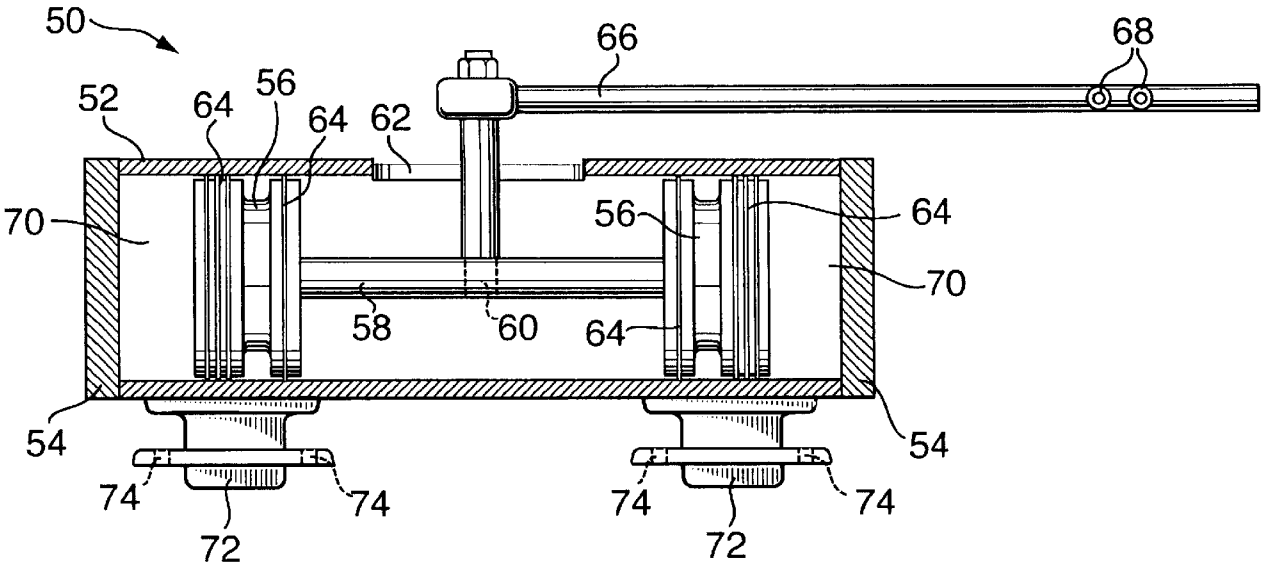
FIGS. 2*a–b* represent side plans of alternative embodiments of the cylinder assembly of the present invention.

FIG. 2*a* represents the detachable cylinder assembly 50 which comprises a cylinder housing, head assemblies 54 at each of the two ends of the cylinder housing 52, two pistons 56 mounted in the cylinder housing 52, a piston connecting rod 58 connecting the two pistons 56 and a piston connecting pin 60 connected to the piston connecting rod 58 and extending through an aperture 62 in the cylinder housing 52. The aperture 62 in the cylinder housing 52 is in a portion of the cylinder housing 52 that is not swept by the compression or oil-control rings 64 of the pistons 56 in normal operation. The end of the piston connection pin that extends through the aperture 62 in the cylinder housing 52 is connected to one end of a cylinder connecting rod 66. The other end of the cylinder connecting rod 66 is connected to power transfer mechanism 68 coupled to the power plate 44. The power transfer mechanism can, for example, take the form of opposed roller bearings with a load receiving portion of the power plate 44 (e.g. cam lobe) passing between the opposed roller bearings as the power plate 44 rotates. The power transfer mechanism can alternatively take on any of a number of forms well know for use in "cam-drive" or "swash plate" engines. The power transfer mechanism in conjunction with the power plate 44 translates the reciprocating motion of the connecting rod 66 to rotating motion of the drive shaft 42. Reciprocating motion is imparted to the cylinder connecting rod 66 from the reciprocating motion of the pistons 56 in the cylinder housing 52.

Figure 2B:
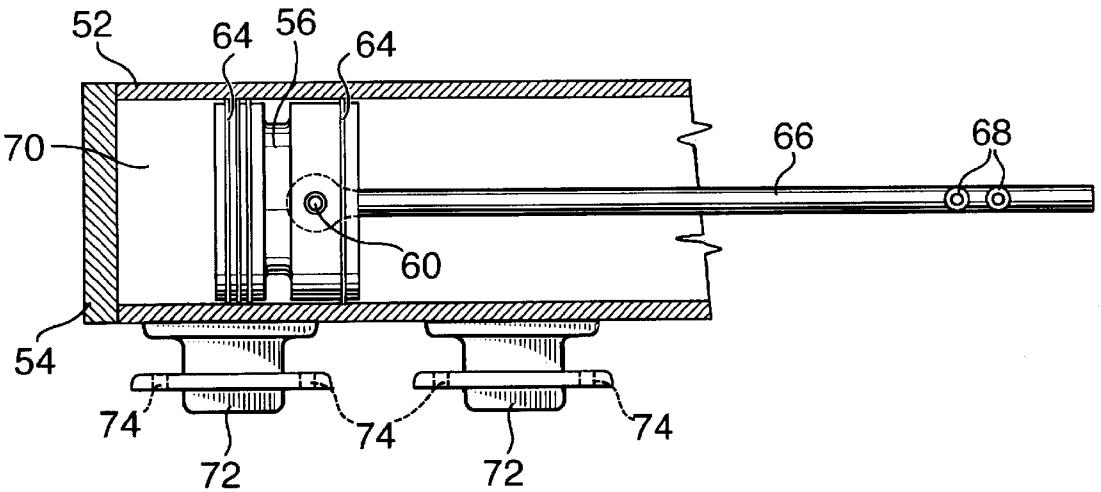

The two pistons 56 in conjunction with the other components in the cylinder assembly 50 form two combustion chambers 70. The two pistons 56 and the piston connecting rod 58 may be constructed in a variety of ways including: as a single unit, or as a combination of parts or assemblies. In another embodiment, the cylinder assembly 50 can comprise only a single piston 56 and a single cylinder head assembly 54 thereby forming a single combustion chamber 70. In this configuration the piston connecting rod 58 would connect to only the one piston 56 or alternatively the piston connecting rod 58 could be deleted and the piston connecting pin 60 would connect directly to the piston 56 as represented in FIG. 2*b*.

Figure 3:
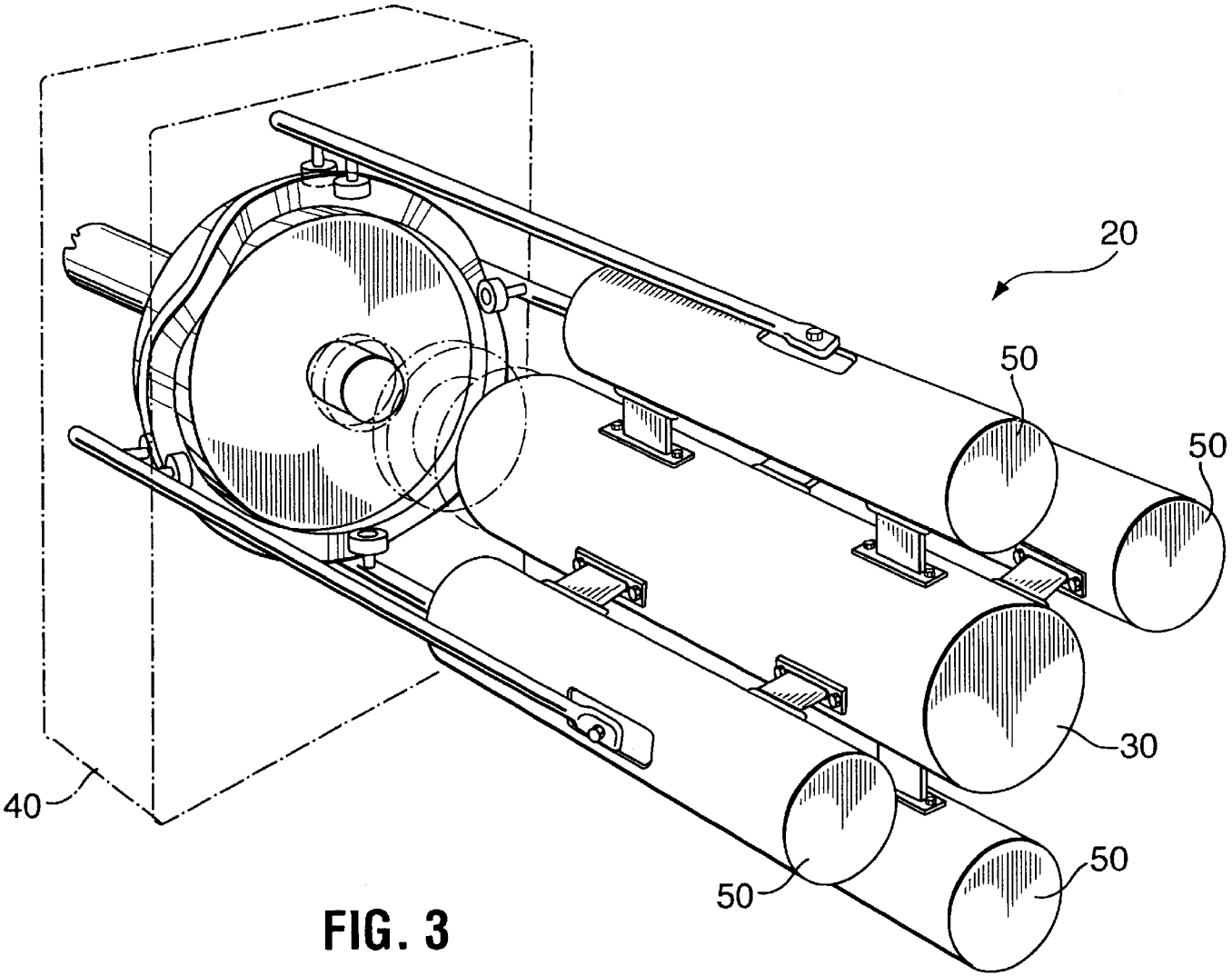
FIG. 3 represents a schematic perspective of a multi-cylinder embodiment of the engine of the present invention.

The present invention provides an alternative cylinder block arrangement to the 'barrel' arrangement used in most "cam-drive" or "swash plate" engines. In the present invention each cylinder comprises part of a detachable cylinder assembly 50 that is not incorporated into a cylinder block per se. The cylinder assembly 50 is rather a "stand-alone" assembly that can be detachably affixed to the other components of the engine (i.e. the engine core 90) without the benefit of a cylinder block. The cylinder assembly 50 can, for example, be affixed via a hub 30. In a further alternative embodiment, represented in FIG. 3, multiple cylinder assemblies can be affixed to the other components of the engine.

With reference to FIG. 1, the hub 30 is substantially cylindrical having mounting positions 33, for attaching one or more cylinder assemblies, disposed circumferentially on its outer surface. The mounting positions 33 can, for example, take the form of a registration slot 32 in the hub 30 and provision for mechanical fasteners 34 to secure the cylinder assembly 50. The cylinder assembly 50 is provided with complementary mechanism such as a registration guide 72, see also FIGS. 2*a* and 2*b*, which mates with the registration slot 32 to provide alignment of the cylinder assembly relative to the power plate and provision for the complementary aspect 74 of the mechanical fasteners 34 to provide mechanical retention of the cylinder assembly. This permits engines of various configurations to be created by affixing one or more cylinder assemblies to the engine core 90. This design would also permit an engine to be 'upgraded' (i.e. have its horsepower or torque generating capacity increased) through the addition of cylinder assemblies.

Figure 4:
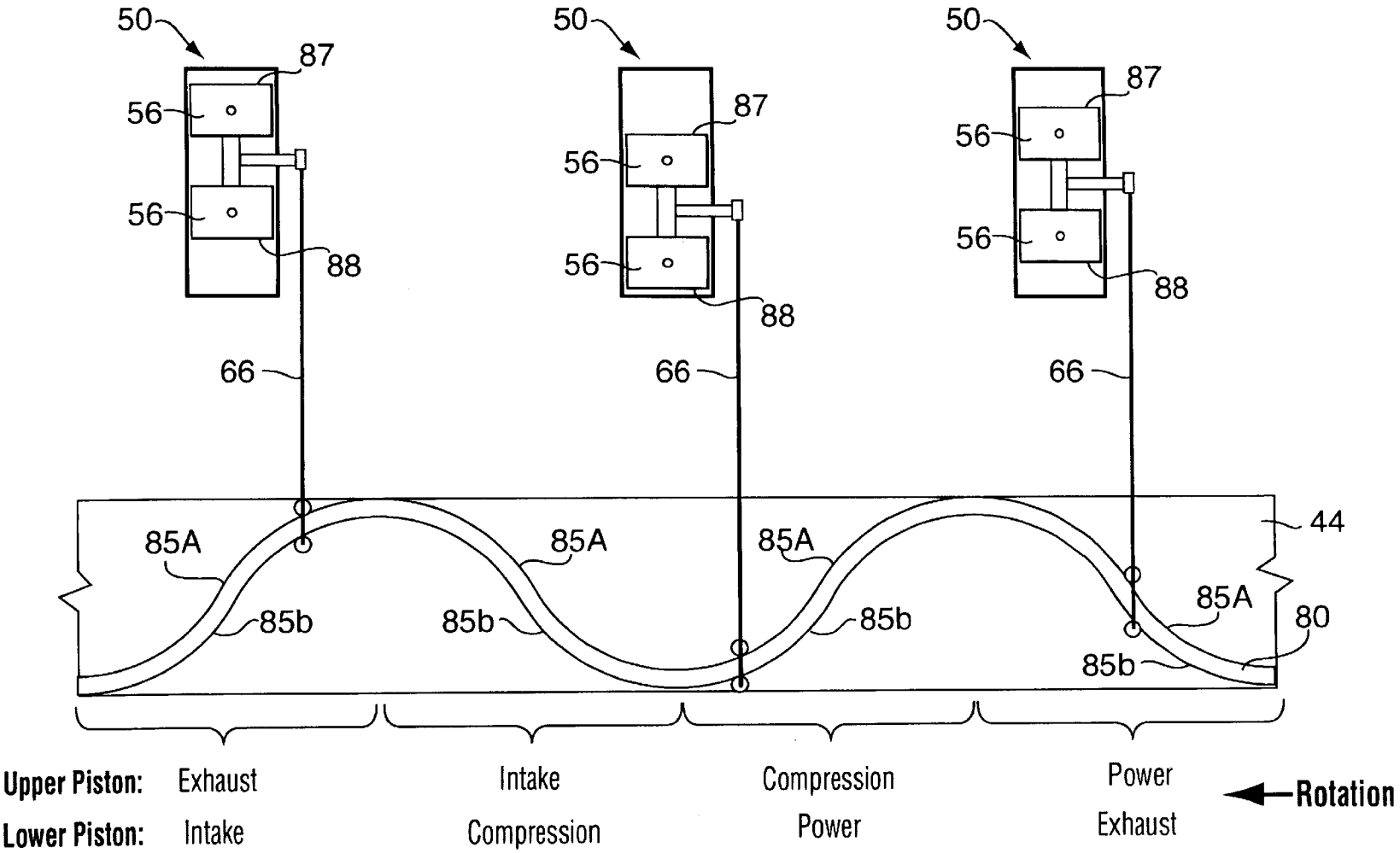
FIG. 4 represents a plan projection of the power plate cam and cylinders of the present invention.

When multiple cylinders assemblies are used, they will be attached at different locations on the outer surface of the hub 30. FIG. 4 represents a multi-cylinder configuration where the periphery of the power plate's 44 cam lobe 80 is projected in a flat plane. An example of the relative positions of the cylinders are also presented in the flat plane projection. At any given point in the rotation of the cam 80, the point in the combustion cycle in which each cylinder is found is a function of where the cylinder is connected to the cam 80. In this embodiment of a cam 80 with two cycles per revolution and cylinders with a four-stroke combustion cycle, each of the four inclined faces 85*a*,85*b* on each side of the cam relates to one of the four combustion cycle strokes in sequence order (i.e. intake, compression, power and exhaust). In this example with two pistons 56 per cylinder 50, the combustion cycle stroke represented by a given cam face 85 will be different for the upper cam face 85*a* than for its corresponding lower cam face 85*b* and therefore different for the upper piston 87 than for the lower piston 88. This relationship is however constant. Understanding this relationship, the relative placement of multiple cylinders can be determined to meet appropriate operating considerations (e.g. balanced power delivery). To facilitate configuration of multi-cylinder engines the cylinder assembly mounting positions 33 can be located on the hub 30 at fixed intervals (e.g. spaced 5 degrees of arc apart).

It will be understood that the structure of the modular engine described herein can facilitate eventual repairs that may be necessary to the pistons 56, pistons rings 64, inner surfaces of the cylinders or other similar components of the engine. The mechanisms that allow a cylinder assembly 50 to be readily affixed to the engine core 90 as an assembled unit also allow it to be readily detached as an assembled unit. This permits repairs by either: removing the cylinder assembly 50, repairing its components and replacing the cylinder assembly 50; or by removing the cylinder assembly 50 and completely substituting it with a replacement cylinder assembly 50. This approach applies individually to each cylinder assembly 50 in an engine with multiple cylinder assemblies. Thereby only those cylinder assemblies that require repair are directly affected in the repair operation. It will be possible in some installations to remove and replace one or more cylinder assemblies without having to remove the entire engine from its operating environment. A further possibility exists that in some engine configurations it may be possible to resume operation of the engine with one or more cylinder assemblies removed during the time the repairs are carried out.

In addition, a manufacturer of the engine could design a set of components such that a single hub 30 configuration and a single power-plate housing 46 configuration and its associated components (i.e. a single engine core 90 configuration) could be used in engines with a variety of different cylinder assembly configurations (not illustrated). The cylinder assembly 50 configurations could vary in terms of cylinder displacement, operating cycle (e.g. two- or four-stroke), ignition/combustion type (e.g. Otto or Diesel) and other similar variations. Engines of various characteristics could be created by connecting cylinder assemblies 50, selected from the different configurations, to engine cores 90 of a common configuration.

Figure 5B:
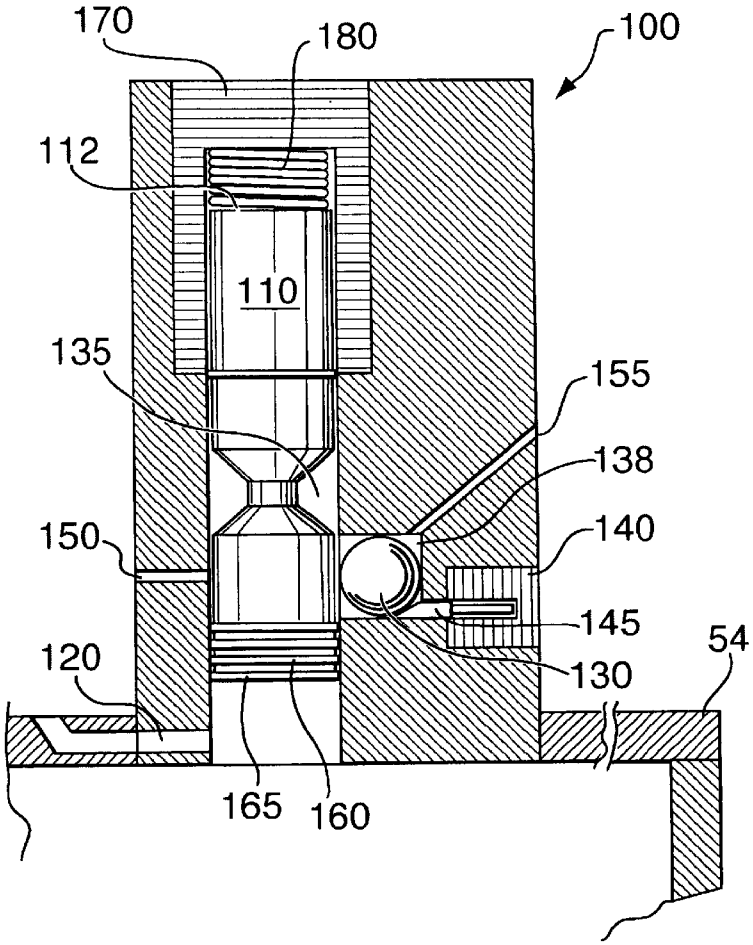
FIGS. 5*a–b* represent side plans of the valves of the present invention in the closed and open positions.
Figure 5A:
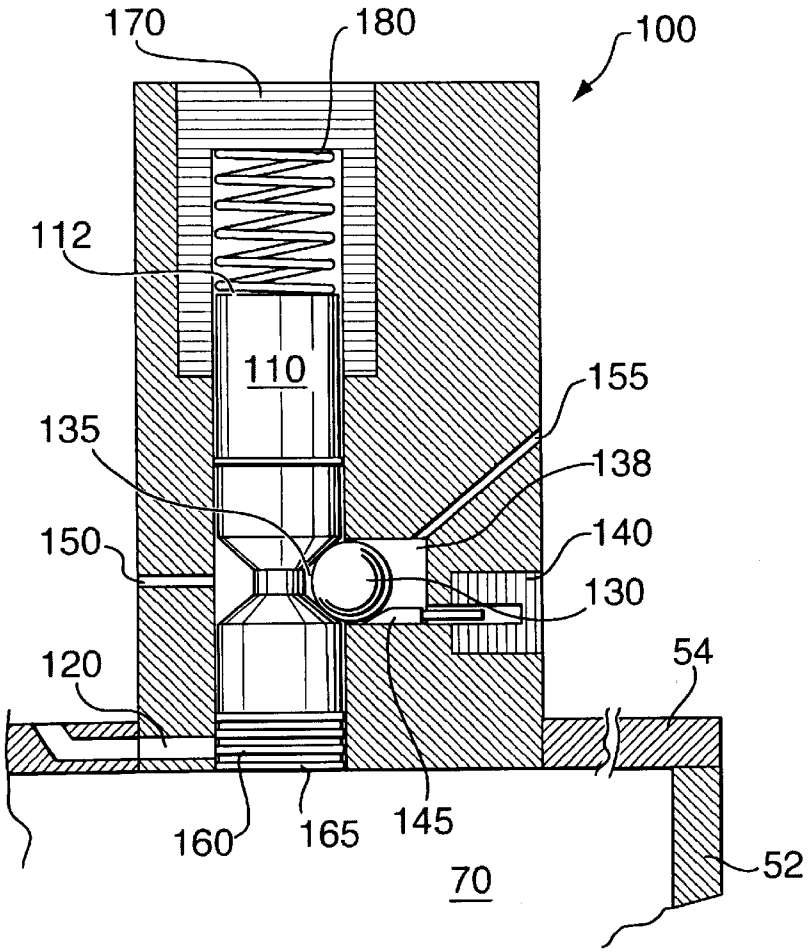

In order to facilitate installation and removal of the cylinder assembly intake and exhaust valves that do not require direct mechanical actuation via camshaft or push-rod can be used. Valves that operate on cylinder pressure or via solenoid actuation would be suitable. Each valve 100 uses a plunger 110 to seal-off (close), as represented in FIG. 5*a*, or expose (open), as represented in FIG. 5*b*, a gas flow port 120. The valves 100 can, for example, be mounted in the cylinder head assembly 54 as represented in FIG. 5*a*.

The intake valve 100 uses an electrical solenoid 170 to draw the plunger 110 into the open position. A return spring 180 is used to drive the plunger 110 into the closed position. Closing of the valve 100 can be assisted by the pressure differential between the combustion chamber 70 and pressure acting on the backside of the plunger 112 or by a second solenoid (not shown) driven opposite to the opening solenoid 170. The pressure on the backside of the plunger 112 can be tailored using a number of mechanisms including use of a return spring 180 biased to closing the plunger 110, sealing or venting of the cavity behind the plunger 110, application of lubricating oil pressure or other similarly well know methods. When the valve 100 is in the closed position, a check ball 130 is used to lock it into position thereby preventing elevated combustion chamber 70 pressures from pushing the valve 100 open. The check ball 130 is driven into a locking race 135 in the plunger 110 by a locking solenoid 140. The locking solenoid 140 acts on the check ball 130 via a locking block 145. The locking block 145 is of a ramped design so that forces acting to push the check ball 130 out of the locked position will cause the check ball 130 to ride up the ramp and bind the check ball 130 in its ball run 138. A biasing pressure provided by the flow of lubricating oil through the valve assembly pushes the check ball 130 out of the locked position when the locking solenoid 140 releases the check ball 130. The lubricating oil supply 150 pressurizes the plunger side of the check ball 130 while oil return 155 occurs on the locking block 145 side of the check ball 130 thereby creating a pressure differential across the check ball 130. The plunger 110 is equipped with oil control seals 160 to prevent oil leakage into the combustion chamber 70. The plunger 110 is also equipped with pressure control seals 165 to prevent pressure leaks from or to the combustion chamber 70 when the valve 100 is closed.

The exhaust valve has a similar structure but different operation from the intake valve. Exhaust valve 100 is driven open by the pressure differential between the combustion chamber 70 and pressure acting on the backside of the plunger 112. The pressure on the backside of the plunger 112 can be tailored using methods as described for the intake valve 100. The pressure on the backside of the plunger 112 can be used to damp or control the speed at which the exhaust valve plunger 110 is driven open. An electrical solenoid 170 is used to drive the plunger 110 into the closed position. The plunger 110 is locked into the closed position using a check ball 130 as described for the intake valve. The plunger 110 is also equipped with oil control seals 160 and pressure control seals 165 similar to the intake valve 100. It will be understood that other well know mechanisms (e.g. pneumatic actuators) can be substituted for the electrical solenoids described in the intake and exhaust valves 100.

Use of valves 100 that operate on cylinder pressure or via solenoid 170 actuation can facilitate modular operation of the engine. Modular operation refers to the technique of temporarily "turning-off" or disabling one or more cylinders in a multi-cylinder engine under certain operating conditions such as partial load situations. The engine of the present invention can be configured for modular operation using well known methods for controlling ignition, fuel delivery and intake and exhaust valve operation on a selective basis. The valves 100 of the present invention lend themselves well to use in modular operation compared to traditional camshaft or push-rod actuated valves.

Figure 6:
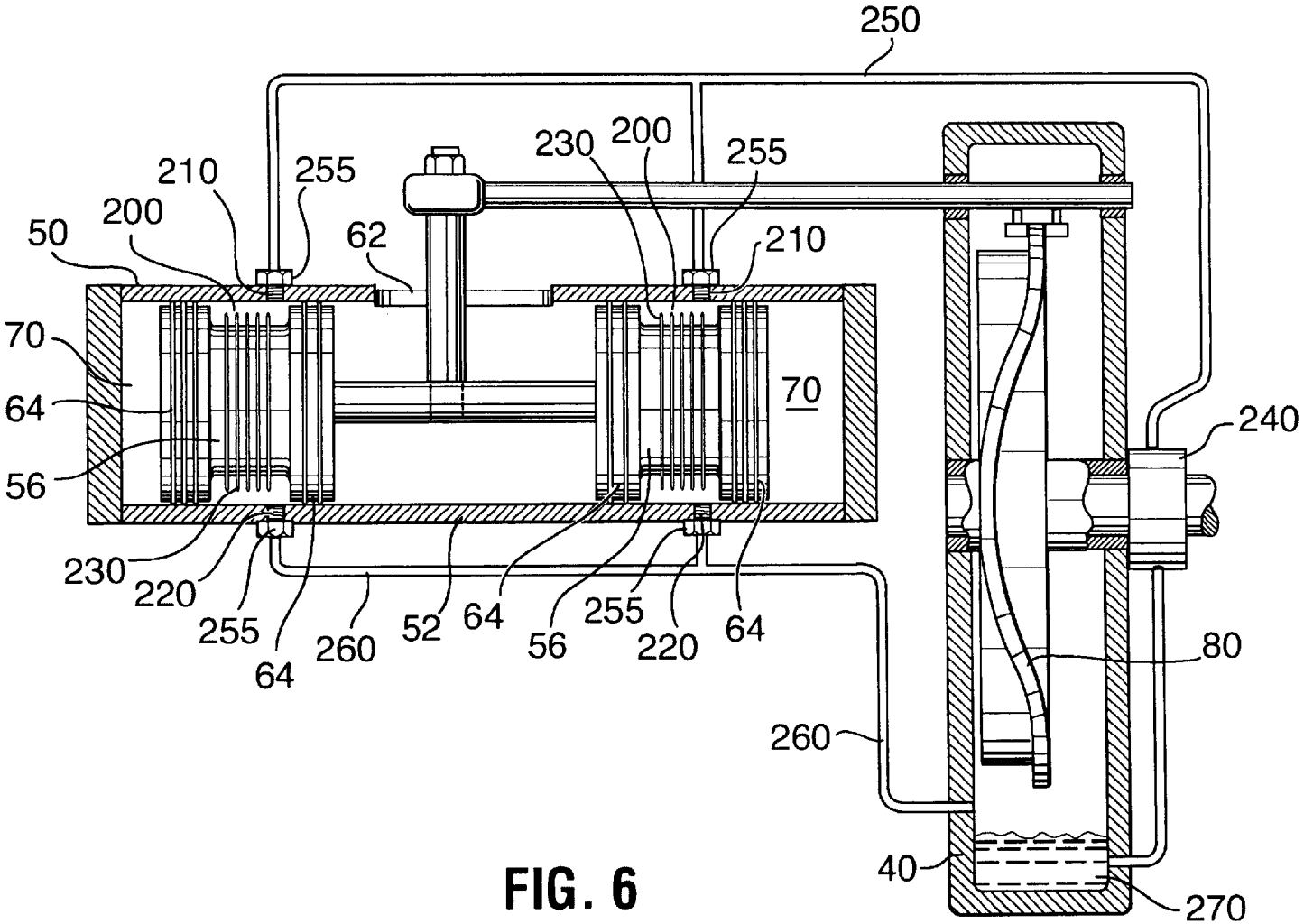
FIG. 6 represents a side plan of the cylinder assembly of the present invention with details of the oil cooling system.

In a further embodiment of the present invention, represented in FIG. 6, that can facilitate the installation and removal of the cylinder assembly 50, lubricating oil is used to cool the pistons 56 and cylinder assembly 50. Each piston 56 is provided with a substantially annular cooling cavity 200 between top and bottom oil control rings 64. Pressurized lubricating oil enters the cooling cavity 200 through an entry passage 210 in the cylinder housing 52, circulates around the piston 56 and exits via an exit passage 220 in the cylinder housing 52. Cooling is achieved by heat conduction to the oil from the piston 56 body and the walls of the cylinder housing 52. The cooling capacity can be increased by increasing the surface area of the piston 56 exposed to the oil. This can be achieved, for example, by the provision of cooling fins 230 on the piston 56 in the cooling cavity 200. The oil also lubricates through contact with the walls of the cylinder housing 52 and the piston rings 64. Oil control rings 64 on the pistons 56 prevent or minimize oil leaks into the combustion chamber 70 or into the portion of the cylinder housing 52 containing the aperture 62 for the piston connecting pin 60. The use of lubricating oil for piston 56 and cylinder assembly 50 cooling eliminates the need for a separate cooling system (e.g. a water jacket based system using a water/glycol coolant) and the associated components and connections. This simplifies the installation and removal of the cylinder assemblies 50 by reducing the number of couplings required.

Engine oil is supplied from an oil pump 240 located, for example, in the power plate assembly 40. Oil from the pump 240 is routed to the cylinder assembly 50 via an oil supply runner 250—e.g. a pressure resistant tube. The oil supply runner 250 is connected to an oil entry passage 210 in the cylinder assembly 50 via a detachable coupling 255. Similarly the return oil from the cylinder assembly 50 is routed via an oil return runner 260 to the oil sump 270 which can be located, for example, in the power plate assembly 40. The oil return runner 260 is connected to an oil exit passage 220 in the cylinder assembly 50 via a detachable coupling 255.

Removal of the cylinder assembly 50 begins with the de-coupling of the ancillary systems as represented in FIG. 7*a*. This includes disconnecting the oil supply 250 and oil return 260 runners from the cylinder assembly 50 via their detachable couplings 255. Electrical voltage supply and grounding 300 for systems such as spark ignition or glow plugs, fuel injectors and solenoid operated valves, which may be provisioned on the cylinder assembly 50 depending on the specific configuration, are disconnected via detachable electrical connectors 305. Disconnection of the exhaust system can be facilitated by equipping the exhaust runner 310 connecting the exhaust port of the cylinder head assembly 54 with the downstream exhaust system (manifold, catalytic converter, header pipe, etc.) with an easily detachable gas tight coupling 320 such as a flare fitting. A similar approach can be used to attached the intake runner 330, which is feed from the upstream intake system, to the intake port in the cylinder head assembly 54.

Once the various ancillary systems have been disconnected, as represented in FIG. 7*b*, the next step in the removal of the cylinder assembly 50 is disconnection of the mechanical components. The cylinder connecting rod 66 can be released from the piston connecting pin 60 via a rod end, spherical or similar joint that connects the two. The other end of the cylinder connecting rod 66 can be left attached. Alternatively, if desired, the connecting rod 66 can be disconnected from the power plate 44 by freeing the guide bearings 350, that support the cylinder connecting rod 66, attached to the power plate housing 46 and then releasing the power transfer mechanism 68 at the end of the cylinder connecting rod 66 from the power plate 44. Removal of the cylinder assembly 50 proper is accomplished by removing the mechanical fasteners 34 that hold the cylinder assembly 50 at the mounting positions 33 on the outer surface of the hub 30 and extracting the cylinder assembly 50. The separated components are represented in FIG. 7*c*. Thus removal and in the reverse process—installation—of the cylinder assembly 50 is accomplished with the cylinder assembly 50 as an assembled unit. It is not necessary to disassembly the cylinder assembly 50 in order to install it in or remove it from the engine.

Figure 8:
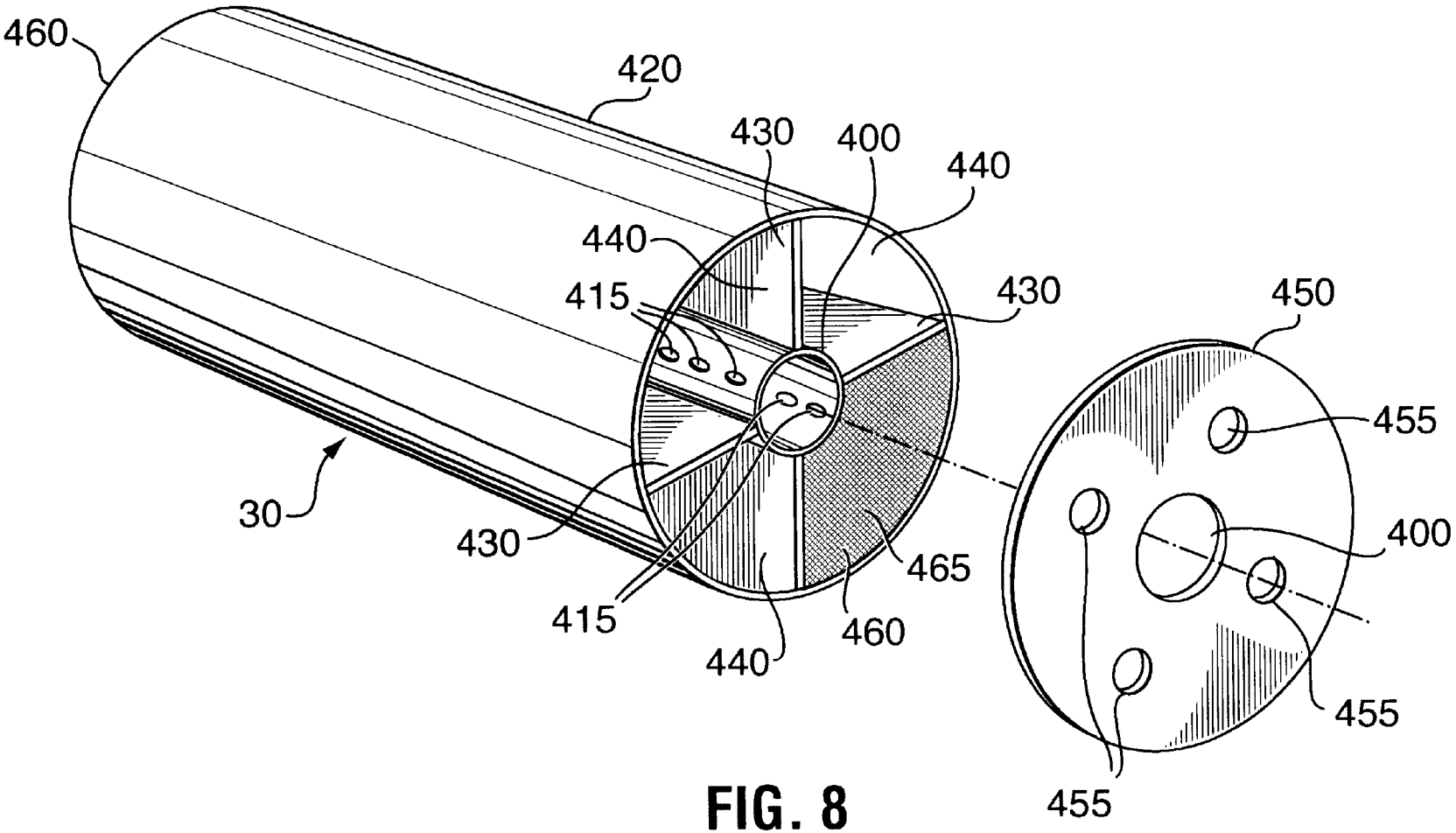
FIG. 8 represents a perspective view of the catalytic converter of the present invention.

In another embodiment of the present invention, the hub 30 can house a catalytic converter for use in reducing exhaust gas emissions. FIG. 8 represents a hub 30 which comprises a substantially cylindrical inner body 410, a substantially cylindrical outer body 420 and a series of supporting webs 430 extending radially from the inner body to the outer body. The webs enclose cavities 440 between the inner 410 and outer 420 bodies. One or more of these cavities 440 can contain a catalytic carrier 460 and a catalyst 465. Exhaust from the cylinder assembly 50, via an exhaust runner 310, enters the cavity 440 through a port 455 in an end cap 450 otherwise sealing the cavities 440 at one end of the hub 30. The other end of the hub 30 is sealed with another cap 460 without a port to the cavity. Exhaust gases having entered via the port 455 and having been exposed to the catalyst 465 exit via a port or ports 415 in the inner body 410. Exhaust gases leave the inner body 410 via an exhaust port 400 in end cap 450 to the downstream exhaust system (not illustrated). It will be understood that the exhaust gas flow could alternatively follow the reverse path—entering the inner body 410 via port 460, then flowing to the cavity 440 via a port or ports 415 in the inner body 410 and exiting via the port 455 in the end cap 450 to the downstream exhaust system. In alternate embodiments there could be multiple ports 455 in the end cap, there could be ports 455,400 in both of the end caps 450,460 or the ports 455 could alternatively be in the outer body 420. Depending on the size of the cavity 440, one or more cylinders could exhaust into the same cavity 440 or one cylinder could exhaust into more than one cavity 440. In this embodiment the close proximity of the catalytic converter in the hub 30 to the cylinder assembly 50 may allow the elimination of certain ancillary emissions control systems which are directed to dealing with the catalyst warm-up issue. The catalyst 465 in the hub 30 will achieve operating temperature more quickly than will the catalyst in a converter mounted substantially downstream in the exhaust system as is typically the case.

It will be apparent to one skilled in the art that numerous modifications and departures form the specific embodiments described herein may be made without departing from the spirit and scope of the invention.

What is claimed is:

1. A cylinder assembly for detachable mounting on a cam-drive engine core having a drive shaft, a power plate affixed to said drive shaft, a power plate housing substantially supporting said drive shaft and said power plate, a cylinder connecting rod connected to said power plate, and a cylinder assembly mounting position connected to said power plate housing, said cylinder assembly comprising:

a cylinder housing with attachment apparatus for detachably mounting at said mounting position;

a cylinder head assembly, affixed to an end of said cylinder housing;

a piston positioned inside of said cylinder housing;

a piston connecting pin connected to said piston; and an aperture in said cylinder housing through which said piston connecting pin is accessible for detachable connection to said cylinder connecting rod;

wherein said cylinder assembly can be attached or detached to said engine core as an assembled unit.

2. The cylinder assembly of claim 1, the attachment apparatus further comprising:

a registration guide which mates with a cooperating registration slot in said mounting position; and mechanical fastening components which connect to cooperating fastening components in said mounting position wherein said registration guide provides alignment of said cylinder assembly and said fastening components provide mechanical retention of said cylinder assembly.

3. The cylinder assembly of claim 1 further comprising:

oil control rings mounted proximate each end of said piston;

an cooling cavity defined between said piston, the interior of said cylinder housing and said oil control rings; and an oil entry passage and an oil exit passage in said cylinder housing accessing said cooling cavity;

wherein oil circulating within said cooling cavity from said entry passage to said exit passage cools said piston and said cylinder housing.

4. The cylinder assembly of claim 1 further comprising:

a solenoid operated intake valve; and a pressure differential and solenoid operated exhaust valve.

5. The cylinder assembly of claim 4, the intake valve further comprising:

a gas flow port;

a plunger;

a resilient means biasing said plunger into a closed position sealing-off said gas flow port;

means for locking said plunger in said closed position; and a solenoid for driving said plunger into an open position exposing said gas flow port.

6. The cylinder assembly of claim 4, the exhaust valve further comprising:

a gas flow port;

a plunger;

a resilient means damping said plunger as it is driven into an open position, exposing said gas flow port, by a pressure differential across said plunger;

a solenoid for driving said plunger into a closed position sealing-off said gas flow port; and means for locking said plunger in said closed position.

7. The cylinder assembly of claim 5, the means for locking further comprising:

a locking race in said plunger;

a check ball;

a substantially ramp shaped locking block;

a locking solenoid acting on said locking block to drive said check ball into said locking race to lock said plunger in said closed position;

oil control seals on said plunger;

a lubricating oil supply passage for oil pressurizing the plunger side of the check ball; and a lubricating oil return passage on the locking block side of the check ball;

wherein a pressure differential created between said oil supply and said oil return passages biases said check ball out of said locking race when said locking solenoid is not acting on said locking block.

8. The cylinder assembly of claim 6, the means for locking further comprising:

a locking race in said plunger;

a check ball;

a substantially ramp shaped locking block;

a locking solenoid acting on said locking block to drive said check ball into said locking race to lock said plunger in said closed position;

oil control seals on said plunger;

a lubricating oil supply pressurizing the plunger side of the check ball; and a lubricating oil return on the locking block side of the check ball;

wherein a pressure differential created between said oil supply and said oil return biases said check ball out of said locking race when said locking solenoid is not acting on said locking block.

9. A cylinder assembly for detachable mounting on a cam-drive engine core having a drive shaft, a power plate affixed to said drive shaft, a power plate housing substantially supporting said drive shaft and said power plate, a cylinder connecting rod connected to said power plate, and a cylinder assembly mounting position connected to said power plate housing, said cylinder assembly comprising:

a cylinder housing with attachment apparatus for detachably mounting at said mounting position;

first and second cylinder head assemblies, one affixed to each end of said cylinder housing;

first and second pistons positioned inside of said cylinder housing;

a piston connecting rod connected at one end to said first piston and at another end to said second piston;

a piston connecting pin connected to said piston connecting rod; and an aperture in said cylinder housing through which said piston connecting pin is accessible for detachable connection to said cylinder connecting rod;

wherein said cylinder assembly can be attached or detached to said engine core as an assembled unit.

10. A cam-drive engine core for detachable mounting of a cylinder assembly having a cylinder housing with attachment apparatus for detachable mounting, a head assembly affixed to an end of said cylinder housing, a piston positioned inside of said cylinder housing, a piston connecting pin connected to said piston, and an aperture in said cylinder housing through which said piston connecting pin is accessible, said engine core comprising:

a drive shaft;

a power plate affixed to said drive shaft;

a power plate housing substantially supporting said drive shaft and said power plate;

a cylinder connecting rod, connected to said power plate, for detachable connection to said piston connecting pin; and a cylinder assembly mounting position, for detachably receiving said cylinder assembly attachment apparatus, connected to said power plate housing;

wherein said cylinder assembly can be attached or detached to said engine core as an assembled unit.

11. The cam-drive engine core of claim 10 for detachable mounting of a plurality of said cylinder assemblies further comprising;

a plurality of cylinder assembly mounting positions, for detachably receiving said cylinder assembly attachment apparatus, connected to said power plate housing; and a plurality of cylinder connecting rods, connected to said power plate, each for detachable connection to one of said piston connecting pins;

wherein each of said plurality of cylinder assemblies can be individually attached or detached to said engine core as an assembled unit.

12. The cam-drive engine core of claim 10 further comprising:

a substantially cylindrical hub, with said cylinder assembly mounting position disposed on its outer surface, connected to said power plate housing;

wherein said hub supports said cylinder assembly relative to said power plate.

13. The cam-drive engine core of claim 12, said hub further comprising:

a substantially cylindrical inner body;

a substantially cylindrical outer body whose radius is greater than that of said inner body;

a plurality of supporting webs that extend from the inner body to the outer body;

a catalytic carrier disposed within a cavity formed between said inner body, said outer body and said supporting webs;

a catalyst disposed on said catalyst carrier;

a first end cap, having an entry port, sealing a first end of said cavity;

a second end cap sealing a second end of said cavity;

an exit port connecting said cavity to the interior of said inner body; and an exhaust port in said first end cap through which exhaust gases in said inner body can flow;

whereby the catalyst is effective at reducing the emissions of exhaust gases circulated from said entry port, through said cavity to said exit port.

14. A cam-drive engine comprising:

an engine core having a drive shaft, a power plate affixed to said drive shaft, a power plate housing substantially supporting said drive shaft and said power plate, a cylinder connecting rod connected to said power plate, and a cylinder assembly mounting position connected to power plate housing; and a cylinder assembly having a cylinder housing with attachment apparatus for detachable mounting at said mounting position, a head assembly affixed to an end of said cylinder housing, a piston positioned inside of said cylinder housing, a piston connecting pin connected to said piston, and an aperture in said cylinder housing through which said piston connecting pin is accessible for connection to said cylinder connecting rod;

wherein said cylinder assembly can be attached or detached to said engine core as an assembled unit.

15. A cam-drive engine comprising:

an engine core having a drive shaft, a power plate affixed to said drive shaft, a power plate housing substantially supporting said drive shaft and said power plate, a plurality of cylinder connecting rods connected to said power plate, and a plurality of cylinder assembly mounting positions connected to power plate housing; and a plurality of cylinder assemblies each having a cylinder housing with attachment apparatus for detachable mounting at one of said plurality of mounting positions, a head assembly affixed to an end of said cylinder housing, a piston positioned inside of said cylinder housing, a piston connecting pin connected to said piston, and an aperture in said cylinder housing through which said piston connecting pin is accessible for connection to one of said plurality of cylinder connecting rod;

wherein each of said plurality of cylinder assemblies can be individually attached or detached to said engine core as an assembled unit.

16. A catalytic converter for proximate location to a cylinder assembly comprising:

a substantially cylindrical inner body;

a substantially cylindrical outer body whose radius is greater than that of said inner body;

a cylinder assembly mounting position, to which said cylinder assembly can be affixed, disposed on the outer surface of said outer body;

a plurality of supporting webs that extend from the inner body to the outer body;

a catalytic carrier disposed within a cavity formed between said inner body, said outer body and said supporting webs;

a catalyst disposed on said catalyst carrier;

a first end cap sealing a first end of said cavity;

an entry port in said first end cap to admit exhaust gases from said cylinder assembly to said cavity, via a exhaust runner;

a second end cap sealing a second end of said cavity;

an exit port connecting said cavity to the interior of said inner body; and an exhaust port in said first end cap through which exhaust gases in said inner body can flow;

whereby the catalyst is effective at reducing the emissions of exhaust gases from said cylinder assembly circulated via said entry port, through said cavity to said exit port.

* * * * *